US011616326B1

(12) United States Patent
Wall et al.

(10) Patent No.: US 11,616,326 B1
(45) Date of Patent: Mar. 28, 2023

(54) CONNECTOR KEYING DEVICE, CONNECTOR SYSTEM, AND METHOD FOR USING SAME

(71) Applicant: Raytheon Company, Waltham, MA (US)

(72) Inventors: Cody L. Wall, Tucson, AZ (US); Dale O. Widmer, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 17/467,820

(22) Filed: Sep. 7, 2021

(51) Int. Cl.

| | |
|---|---|
| ***H01R 13/645*** | (2006.01) |
| ***H01R 13/514*** | (2006.01) |
| ***H01R 31/06*** | (2006.01) |
| ***H01R 24/84*** | (2011.01) |

(52) U.S. Cl.
CPC ..... *H01R 13/6456* (2013.01); *H01R 13/514* (2013.01); *H01R 31/06* (2013.01); *H01R 24/84* (2013.01)

(58) Field of Classification Search
CPC .. H01R 13/6456; H01R 13/514; H01R 31/06; H01R 24/84
See application file for complete search history.

(56) References Cited

U.S. PATENT DOCUMENTS

| | | | | |
|---|---|---|---|---|
| 3,112,974 | A | 12/1963 | Curtis | |
| 4,368,942 | A | 1/1983 | Mathe | |
| 4,929,184 | A | 5/1990 | Emadi | |
| 4,934,950 | A | 6/1990 | Green | |
| 6,302,744 | B1 | 10/2001 | Nomura | |
| 6,821,159 | B2 | 11/2004 | Munger, Jr. | |
| 9,166,341 | B2 * | 10/2015 | Wang | H01R 13/645 |

FOREIGN PATENT DOCUMENTS

| | | |
|---|---|---|
| EP | 0573396 B1 | 3/1996 |

OTHER PUBLICATIONS

International Search Report for PCT/US2022/042740 dated Jan. 2, 2023.

* cited by examiner

*Primary Examiner* — Briggitte R. Hammond
(74) *Attorney, Agent, or Firm* — Getz Balich LLC

(57) ABSTRACT

A connector keying system includes at least one keying device including a flange portion and a keying portion. The flange portion includes a front surface and a back surface. Each of the front surface and the back surface extend substantially parallel to a flange plane. The flange portion further includes a connector aperture extending through the flange portion. The keying portion extends around an aperture perimeter of the connector aperture and projects outward from the flange portion. The keying portion includes and extends between a first key end located at the front surface and a second key end opposite the first key end. The second key end defines a keying perimeter about the connector aperture. The keying portion has a height between the first key end and the second key end and the height is inconsistent between the first key end and the second key end along the keying perimeter.

19 Claims, 7 Drawing Sheets

CONNECTOR KEYING DEVICE, CONNECTOR SYSTEM, AND METHOD FOR USING SAME

BACKGROUND

1. Technical Field

This disclosure relates generally to electrical connectors, and more particularly to keying systems for preventing misconnections between electrical connectors.

2. Background Information

Electrical and electronics systems such as computer systems, test equipment systems, controllers, etc. may frequently include electrical connectors which must be correctly coupled with an intended counterpart electrical connector in order for the system to properly operate. In some cases, systems may include numerous electrical connectors which may have a similar appearance, shape, and/or pin-socket configuration. Accordingly, there is a risk of connector misconnection, for example, as a result of user error during system assembly or repair. To address the risk of connector misconnection, some prior art electrical connectors have been fitted with custom jacking hardware which includes keying features configured to assist users with connector coupling. However, in some cases, the use of jacking hardware for this purpose has required users to physical modify existing electrical connectors to accommodate the custom jacking hardware. Users may also need to manually configure the keying features (e.g., pins) of the jacking hardware for each connector pair. Further, if the jacking hardware is improperly keyed, the benefits of the keying features may be negated. In other words, conventional connector keying systems may add undesirable complexity when seeking to prevent connector misconnections. Accordingly, what is needed is a keying system which prevents misconnection between electrical connectors while also addressing one or more of the above-noted issues associated with conventional keying systems.

SUMMARY

It should be understood that any or all of the features or embodiments described herein can be used or combined in any combination with each and every other feature or embodiment described herein unless expressly noted otherwise.

According to an aspect of the present disclosure, a connector keying system for use with a connector pair includes at least one keying device including a flange portion and a keying portion. The flange portion includes a front surface and a back surface opposite the front surface. Each of the front surface and the back surface extend substantially parallel to a flange plane. The flange portion further includes a connector aperture extending through the flange portion from the back surface to the front surface. The keying portion extends around an aperture perimeter of the connector aperture and projects outward from the flange portion in a direction substantially perpendicular to the flange plane. The keying portion includes and extends between a first key end located at the front surface and a second key end opposite the first key end. The second key end defines a keying perimeter about the connector aperture. The keying portion has a height between the first key end and the second key end and the height is inconsistent between the first key end and the second key end along the keying perimeter.

In any of the aspects or embodiments described above and herein, the at least one keying device may include a first keying device and a second keying device and with the second key end of the first keying device mounted against the second key end of the second keying device about the respective keying perimeter of the first keying device and the second keying device, the flange plane of the first keying device may be substantially parallel to the flange plane of the second keying device.

In any of the aspects or embodiments described above and herein, the second key end of the keying portion may be skewed relative to the flange plane along a first portion of the keying perimeter.

In any of the aspects or embodiments described above and herein, the second key end of the keying portion may be substantially parallel to the flange plane along a second portion of the keying perimeter.

In any of the aspects or embodiments described above and herein, the flange portion may include at least one fastener aperture extending through the flange portion from the back surface to the front surface.

In any of the aspects or embodiments described above and herein, the at least one keying device may include at least one attachment feature.

In any of the aspects or embodiments described above and herein, the keying portion may extend from the flange portion at a location of the aperture perimeter.

According to another aspect of the present disclosure, a connector system includes a first connector pair including a first male connector and a first female connector configured for electrical coupling with the first male connector. Each of the first male connector and the first female connector include a connector flange portion and a connector shell portion extending outward from the connector flange portion. The connector shell portion of the first male connector surrounds a plurality of pins and the connector shell portion of the first female connector surrounds a plurality of sockets configured to receive the respective plurality of pins. The connector system further includes a first connector keying system including a first at least one keying device including a flange portion and a keying portion. The flange portion includes a front surface and a back surface opposite the front surface. Each of the front surface and the back surface extend substantially parallel to a flange plane. The flange portion further includes a connector aperture extending through the flange portion from the back surface to the front surface. The keying portion extends around an aperture perimeter of the connector aperture and projects outward from the flange portion in a direction substantially perpendicular to the flange plane. The keying portion includes and extends between a first key end located at the front surface and a second key end opposite the first key end. The second key end defines a keying perimeter about the connector aperture. The keying portion has a height between the first key end and the second key end and the height is inconsistent between the first key end and the second key end along the keying perimeter. The at least one keying device is configured for installation on one or both of the male connector and the female connector so that the back surface of the flange portion contacts the connector flange portion and the keying portion surrounds the connector shell portion.

In any of the aspects or embodiments described above and herein, the first at least one keying device may include a first keying device installed on the first male connector and a second keying device installed on the first female connector. The first at least one keying device may be configured so that, with the second key end of the first keying device mounted against the second key end of the second keying device about the respective keying perimeter of the first keying device and the second keying device, the flange plane of the first keying device is substantially parallel to the flange plane of the second keying device.

In any of the aspects or embodiments described above and herein, the connector system may further include a second connector pair including a second male connector and a second female connector configured for electrical coupling with the second male connector. The second male connector may be configured for electrical coupling with the first female connector and the second female connector may be configured for electrical coupling with the first male connector. The connector system may further include a second connector keying system including a second at least one keying device including a third keying device installed on the second male connector and a fourth keying device installed on the second female connector.

In any of the aspects or embodiments described above and herein, the first keying device and the second keying device may be a first matching color and the third keying device and the fourth keying device may be a second matching color which is different than the first matching color.

In any of the aspects or embodiments described above and herein, the first keying device may be configured to physically prevent electrical coupling of the second female connector with the first male connector and the second keying device may be configured to physically prevent electrical coupling of the second male connector with the first female connector.

In any of the aspects or embodiments described above and herein, the third keying device and the fourth keying device may be different than the first keying device and the second keying device, respectively.

In any of the aspects or embodiments described above and herein, the respective keying portion of the third keying device and the fourth keying device may have a different shape than the respective keying portion of the first keying device and the second keying device, respectively.

In any of the aspects or embodiments described above and herein, the first at least one keying device may include at least one attachment feature and the at least one attachment feature may attach the first at least one keying device to the connector flange portion.

In any of the aspects or embodiments described above and herein, the connector shell portion may include and extend between a first shell end in contact with the connector flange portion and a second shell end opposite the first shell end. The connector shell portion may have a second height between the first shell end and the second shell end. The second height may be greater than a maximum of the height between the first key end and the second key end.

According to another aspect of the present disclosure, a method for preventing electrical misconnection for a connector system is provided. The method includes providing a first connector pair including a first male connector and a first female connector configured for electrical coupling with the first male connector. Each of the first male connector and the first female connector include a connector flange portion and a connector shell portion extending outward from the connector flange portion. The connector shell portion of the first male connector surrounds a plurality of pins and the connector shell portion of the first female connector surrounds a plurality of sockets configured to receive the respective plurality of pins. The method further includes installing a first at least one keying device on one or both of the male connector and the female connector so that a back surface of a flange portion of the first at least one keying device contacts the connector flange portion and a keying portion of the at least one keying device surrounds the connector shell portion. The flange portion includes a front surface and the back surface opposite the front surface. Each of the front surface and the back surface extends substantially parallel to a flange plane. The flange portion further includes a connector aperture extending through the flange portion from the back surface to the front surface. The keying portion extends around an aperture perimeter of the connector aperture and projects outward from the flange portion in a direction substantially perpendicular to the flange plane. The keying portion includes and extends between a first key end located at the front surface and a second key end opposite the first key end. The second key end defines a keying perimeter about the connector aperture. The keying portion has a height between the first key end and the second key end and the height is inconsistent between the first key end and the second key end along the keying perimeter.

In any of the aspects or embodiments described above and herein, the first at least one keying device may include a first keying device and a second keying device and the step of installing the first at least one keying device may include installing the first keying device on the first male connector and installing the second keying device on the first female connector. With the first at least one keying device installed, the at least one keying device may be configured so that, with the second key end of the first keying device mounted against the second key end of the second keying device about the respective keying perimeter of the first keying device and the second keying device, the flange plane of the first keying device is substantially parallel to the flange plane of the second keying device.

In any of the aspects or embodiments described above and herein, the method may further include providing a second connector pair including a second male connector and a second female connector configured for electrical coupling with the second male connector. The second male connector may be configured for electrical coupling with the first female connector and the second female connector may be configured for electrical coupling with the first male connector. The first keying device may be configured to physically prevent electrical coupling of the second female connector with the first male connector and the second keying device may be configured to physically prevent electrical coupling of the second male connector with the first female connector.

In any of the aspects or embodiments described above and herein, the method may further include attaching the first at least one keying device to the connector flange portion with at least one attachment feature.

The present disclosure, and all its aspects, embodiments and advantages associated therewith will become more readily apparent in view of the detailed description provided below, including the accompanying drawings.

DETAILED DESCRIPTION

The present disclosure is directed to an electrical connector keying system and to electrical connector systems that include such connector keying systems. As will be clear from the description below, the connector keying system can be used with a wide variety of connectors. Embodiments of the present disclosure connector keying system can be configured for use with many existing types of connectors (e.g., connectors that are currently available to the public) having a variety of different electrical and geometric configurations.

Figure 1:
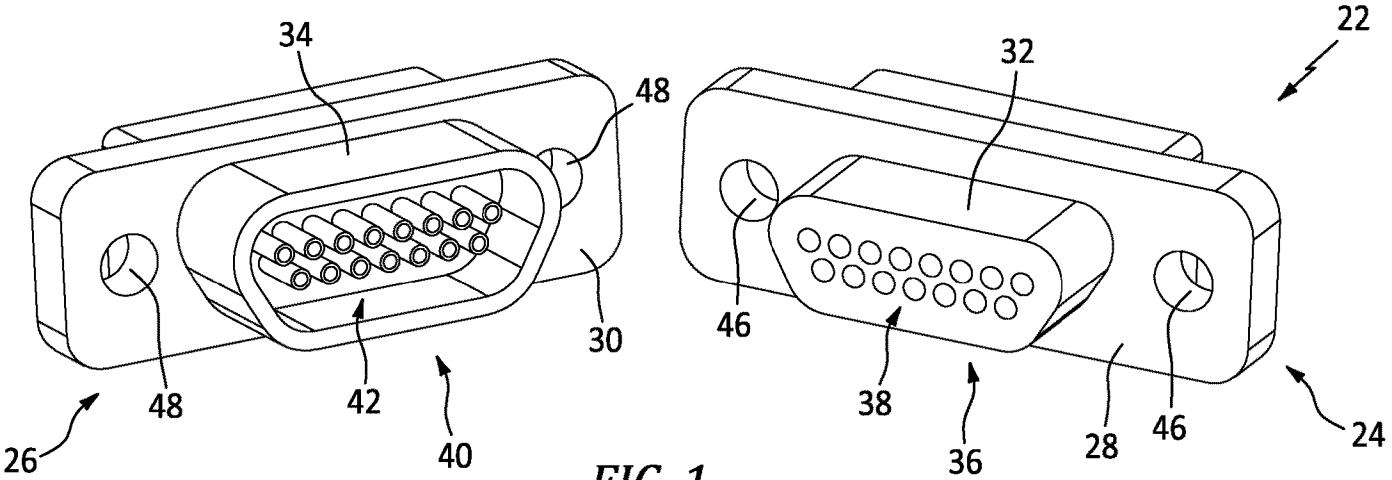
FIG. 1 illustrates a perspective view of a connector pair, in accordance with one or more embodiments of the present disclosure.
Figure 2:
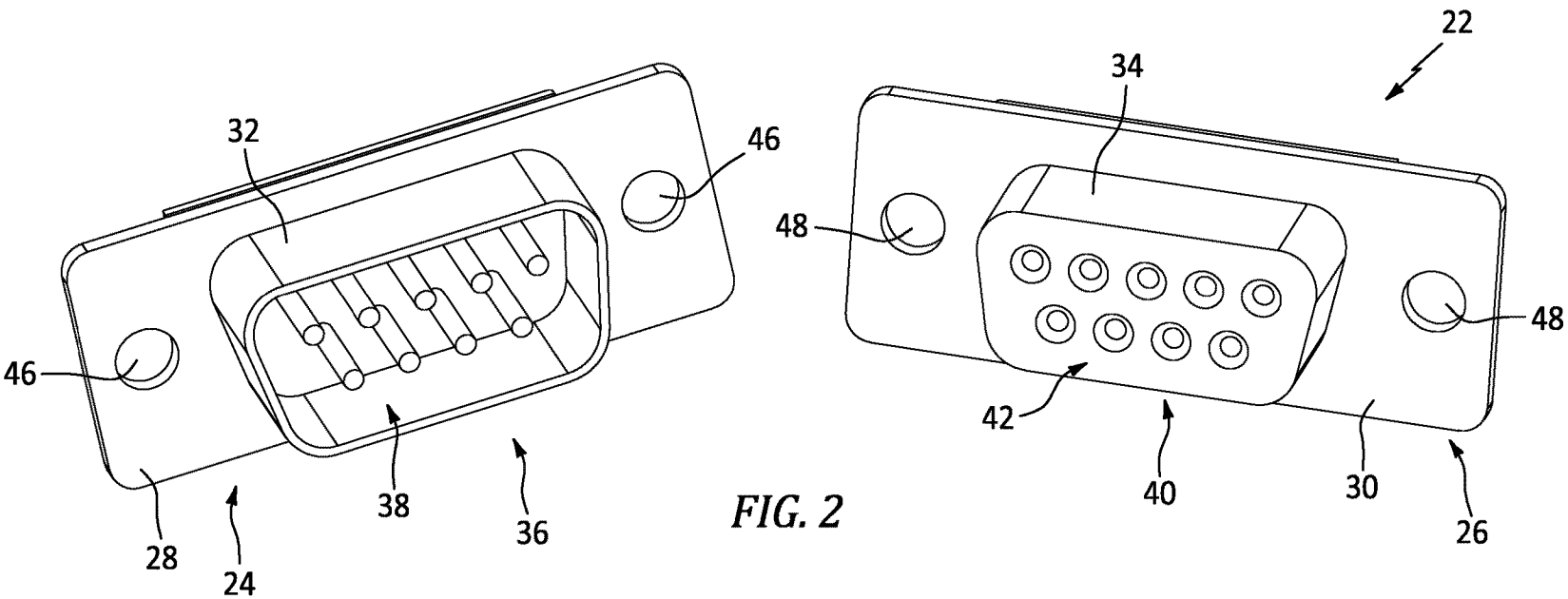
FIG. 2 illustrates a perspective view of a connector pair, in accordance with one or more embodiments of the present disclosure.

To facilitate the description herein, embodiments of the present disclosure connector keying system 20 will be primarily described as it may be used with a connector pair 22; e.g., a male connector 24 and a female connector 26 configured for electrical coupling with the male connector 24. FIGS. 1 and 2 illustrate examples of such connector pairs 22. FIG. 1 illustrates an exemplary "micro-D" style electrical connector pair. FIG. 2 illustrates an exemplary "D-subminiature" style electrical connector pair. Each of the exemplary connectors 24, 26 includes respective flange portions 28, 30 and shell portions 32, 34 extending outward from the flange portion 28. To be clear, the configuration of the connectors 24, 26 illustrated in FIGS. 1 and 2 is exemplary, and the present disclosure connector keying system 20 is not limited to use with the illustrated connectors 24, 26.

On the male connector 24, the shell portion 32 defines an exterior housing of a plug 36 including a plurality of pins 38 surrounded by the shell portion 32. On the female connector 26, the shell portion 34 defines an exterior housing of a receptacle 40 including a plurality of sockets 42 surrounded by the shell portion 34. The plurality of sockets 42 are configured to receive and make electrical contact with the respective plurality of pins 38 of the male connector 24. In some embodiments, the shell portion 32 of the male connector 24 and the shell portion 34 of the female connector 26 are sized so that the shell portion 32 can be inserted into the shell portion 34 or, alternatively, so that the shell portion 34 can be inserted into the shell portion 32. As used herein, the term "electrical coupling" refers to establishing electrical contact between the plurality of pins 38 of the male connector 24 and the plurality of sockets 42 of the female connector 26 by full and proper insertion of the male connector 24 with the female connector 26.

The flange portions 28, 30 of each of the connectors 24, 26 may include fastener apertures 46, 48. With the connectors 24, 26 in a connected state, i.e., with the female connector 26 electrically coupled with the male connector 24, the fastener apertures 48 of the female connector 26 may be aligned with the fastener apertures 46 of the male connector 24 such that the connectors 24, 26 may be positioned into and/or secured in the connected state with jacking hardware (not shown). Jacking hardware may include, for example, jack screws configured to extend through the fastener apertures 46, 48 of the connectors 24, 26 for threaded engagement with respective jack posts. Jacking hardware may additionally include one or more locking devices configured to retain the connectors 24, 26 in the connected state and/or prevent unthreading between one or more jack screws and respective jack posts. In some embodiments, one or both of the connectors 24, 26 may include integrated jacking hardware, e.g., jacking hardware may be attached to or formed with the connector. In some other embodiments, such as the connector embodiments shown in FIGS. 1 and 2, the connectors 24, 26 may not include integrated jacking hardware and, in some cases, custom jacking hardware may be used to position and/or secure the connectors 24, 26 in the connected state. In some cases, connectors may not require the use of any jacking hardware and the present disclosure is not limited to any particular jacking hardware configuration for connectors. Further, the connectors 24, 26 of the present disclosure are not limited to any particular number of fastener apertures 46, 48 and some connectors may not include any fastener apertures at all.

Some common commercial connectors, such as those connector styles illustrated in FIGS. 1 and 2, may not include integrated keying or polarization features and may demonstrate a greater likelihood of experiencing a misconnection during assembly of an associated electrical or electronic system. As used herein, the term "misconnection" refers to the act of inadvertently electrically coupling two connectors which may or may not be configured for electrical coupling with one another and are not intended (e.g., by system design) to be electrically coupled with one another. Misconnections between electrical connectors in an electrical and/or electronic system can result in improper system operation or system failure and, in some cases, may even result in damage to electrical and/or electronic equipment.

Figure 4:
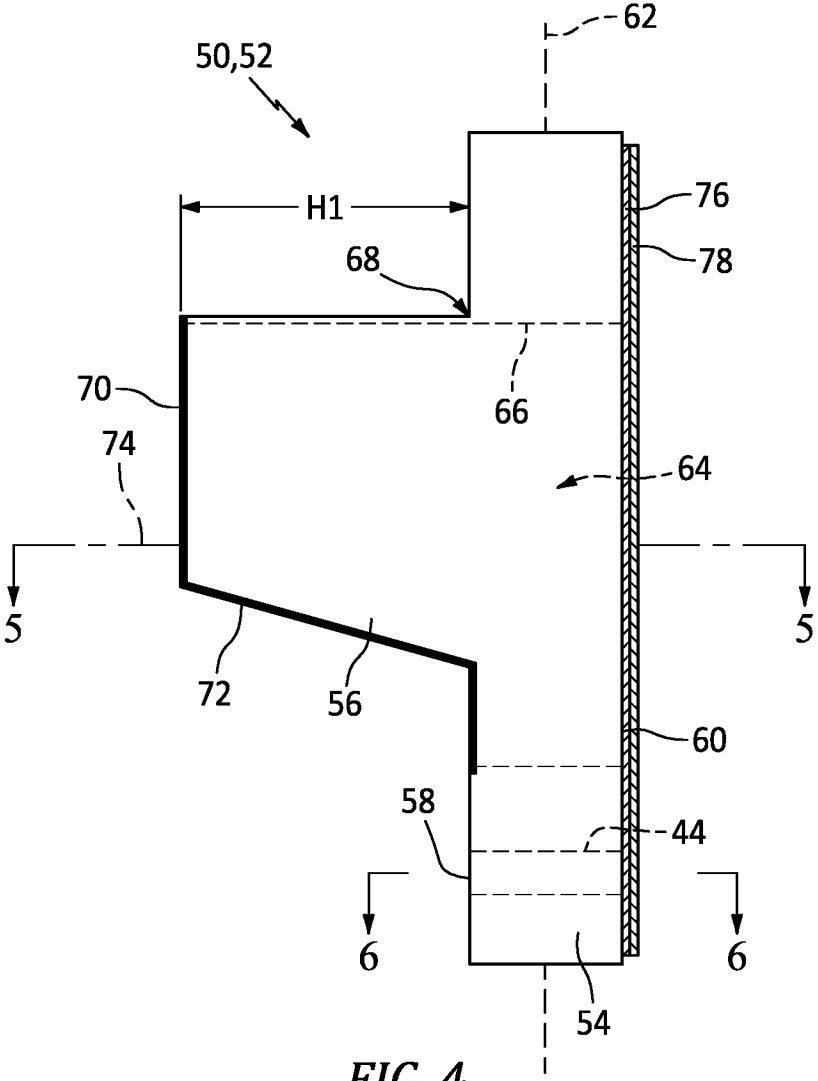
FIG. 4 illustrates a top view of a connector keying device for the connector keying system of FIG. 3, in accordance with one or more embodiments of the present disclosure.
Figure 3:
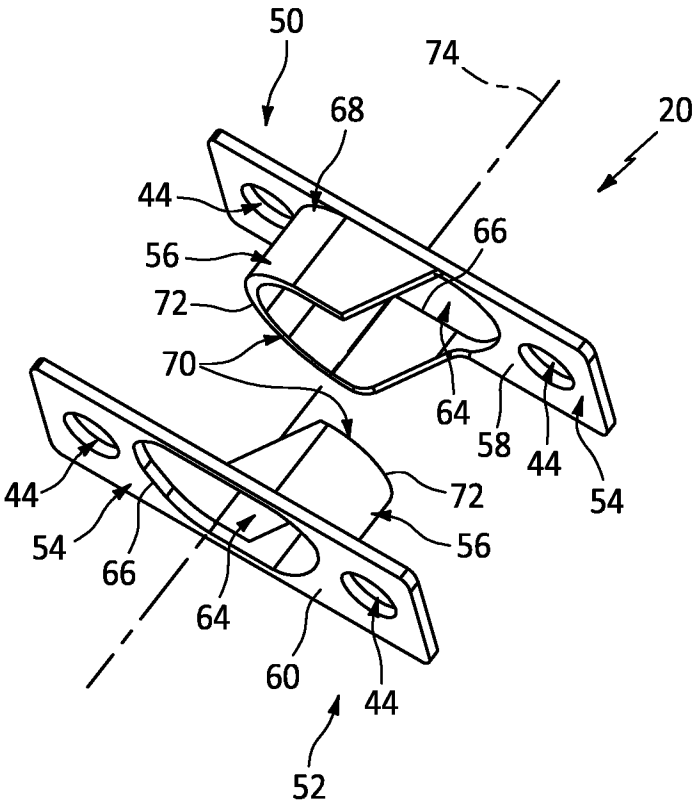
FIG. 3 illustrates a perspective view of a connector keying system, in accordance with one or more embodiments of the present disclosure.
Figure 5B:
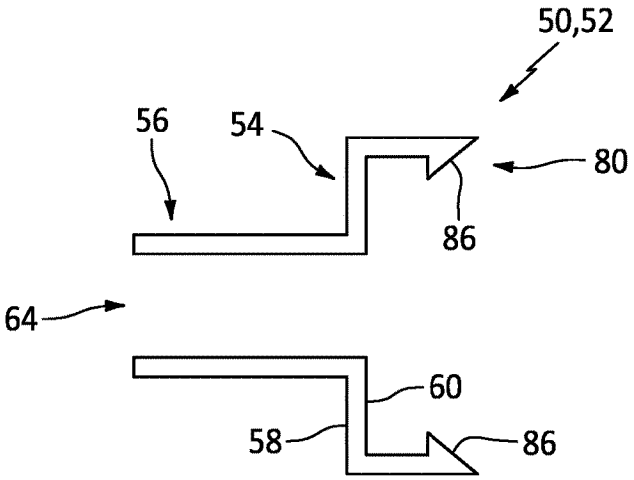
FIGS. 5A-B illustrate side cross-sectional views of the connector keying device of FIG. 4 taken along Line 5-5 and including exemplary mechanical attachment features, in accordance with one or more embodiments of the present disclosure.

Referring to FIGS. 3-4, connector keying system 20 embodiments according to the present disclosure include a first keying device 50 and a second keying device 52. Each of the keying devices 50, 52 includes a flange portion 54 and a keying portion 56. The flange portion 54 includes a front surface 58 and a back surface 60 opposite the front surface 58. Each of the front surface 58 and the back surface 60 extend substantially parallel to a flange plane 62. The flange portion 54 further includes a connector aperture 64 extending through the flange portion 54 from the back surface 60 to the front surface 58. The connector aperture 64 may be sized to closely accommodate a shape of the shell portion 32, 34 of the respective connector 24, 26 and may have a shape which is substantially similar to the shell portion 32, 34 of the respective connector 24, 26 (see FIGS. 1 and 2). For example, the connector aperture 64 may have a cross-sectional shape corresponding substantially to a circle, an oval, an ellipse, a square, a rectangle, a trapezoid, a D-shape, etc. The present disclosure is not limited to any particular cross-sectional shape of the connector aperture 64 or to any size or shape of the connector aperture 64 with respect to a corresponding connector 24, 26. The connector aperture 64 is defined about a connector axis 74 which is substantially perpendicular to the flange plane 62. The connector aperture 64 includes an aperture perimeter 66 defined by the flange portion 54. As used herein, the term "substantially" with regard to an angular relationship refers to the noted angular relationship (e.g., "parallel," "perpendicular," etc.)+/−5 degrees.

The flange portion 54 may additionally include at least one fastener aperture 44 extending through the flange portion 54 from the back surface 60 to the front surface 58. As will be discussed in further detail, the at least one fastener aperture 44 may have a predetermined position which corresponds to the position of the fastener apertures 46, 48 of the connector 24, 26 with which the connector keying system 20 is configured to be used (see FIGS. 1 and 2). In some embodiments, the flange portion 54 may not include the at least one fastener aperture 44. For example, the flange portion 54 may be configured to be entirely disposed between the fastener apertures 46, 48 of a respective connector 24, 26. Like the connectors 24, 26, the keying devices 50, 52 of the present disclosure are not limited to any particular number of fastener apertures 44 and some keying devices may not include any fastener apertures at all.

The keying portion 56 projects outward from the flange portion 54, for example, in a direction substantially perpendicular to the flange plane 62 and substantially parallel to the connector axis 74. The keying portion 56 includes and extends between a first end 68 located at, in contact with, or otherwise mounted to the front surface 58 of the flange portion 54, and a second end 70 opposite the first end 68. In some embodiments, the keying portion 56 extends from the flange portion 54 at the location of the aperture perimeter 66. However, in some other embodiments, all or a portion of the keying portion 56 may be spaced from the aperture perimeter 66. For example, all or a portion of the keying portion 56 may be radially spaced from the aperture perimeter 66 with respect to the connector axis 74. The keying portion 56 extends around the aperture perimeter 66 of the connector aperture 64. The second end 70 of the keying portion 56 defines a keying perimeter 72 (e.g., illustrated in bold on FIG. 4) disposed about the connector aperture 64. In some embodiments, the flange portion 54 and the keying portion 56 may form a unitary structure of the respective first keying device 50 and/or second keying device 52. The term "unitary structure," as used herein, means a single component, wherein all elements of the first keying device 50 and/or the second keying device 52 (e.g., the flange portion 54 and the keying portion 56) are an inseparable body (e.g., formed of a single material). In some other embodiments, the keying portion 56 may be attached to the flange portion 54, for example, by welding, adhesive bonding, snap-lock or other mechanical connection, and/or any other suitable means for attachment.

The first keying device 50 and the second keying device 52 of the connector keying system 20 may be made from a wide range of materials such as, but not limited to metal or other lightweight and easily fabricated materials such as plastic or composite materials. The keying devices 50, 52 may be formed, for example, by injection molding or additive manufacturing. The present disclosure is not limited to any particular materials or means for forming the keying devices 50, 52.

The keying portion 56 has a height H1 between the first end 68 and the second end 70. The height H1 between the first end 68 and the second end 70 of the keying portion 56 may vary in different areas of the keying portion 56. For example, the height H1 between the first end 68 and the second end 70 of the keying portion 56 may be inconsistent along the keying perimeter 72. In some embodiments, the keying perimeter 72 may be non-planar; e.g., the entire keying perimeter 72 may not be located on a single geometric plane. In some embodiments, the second end 70 of the keying portion 56 may be skewed relative to the flange plane 62 along a portion of the keying perimeter 72. Alternatively or additionally, in some embodiments, the second end 70 of the keying portion 56 may be substantially parallel to the flange plane 62 along a portion of the keying perimeter 72. Further, in some embodiments, portions of the second end 70 of the keying portion 56 along the keying perimeter 72 may include curves, angles, steps, and/or other geometric shapes. FIGS. 3 and 7-10 illustrate exemplary keying portion 56 shapes, however, the present disclosure connector keying system 20 is not limited to any particular shape of the keying portion 56.

In some embodiments, one or both of the first keying device 50 and the second keying device 52 may optionally include an attachment feature configured for attaching the first keying device 50 and/or the second keying device 52 to a respective connector 24, 26, as will be discussed in further detail. For example, as shown in FIG. 4, in some embodiments, one or both of the first keying device 50 and the second keying device 52 may include an adhesive 76 disposed on the back surface 60 of the flange portion 54 to securely attach the keying device 50, 52 to a respective connector 24, 26. Non-limiting examples of the adhesive 76 include glue, adhesive tape, spray adhesive, and the like. In some embodiments, the keying device 50, 52 may include a release liner 78 extending along and covering the adhesive 76. The release liner 78 may aid in packaging and/or handling of the keying device 50, 52 to prevent inadvertent adhesion of the adhesive 76 prior to installation of the keying device 50, 52. The release liner 78 is not limited to any particular material. Preferably, the release liner 78 may be made from a material which can be securely retained by the adhesive 76 but can be selectively removed from the adhesive 76 with little effort and without diminishing the adhesion characteristics of the adhesive 76. Non-limiting examples of release liner 78 materials may include paper or polymeric sheets. In some embodiments, the release liner 78 may be coated with a release agent configured to reduce the adherence of the release liner 78 to the adhesive 76.

Referring to FIGS. 3-6, in some embodiments, the attachment feature may be a mechanical attachment feature 80 of one or both of the first keying device 50 and the second keying device 52. The mechanical attachment feature 80 may be used as an alternative to or in addition to the adhesive 76 for securing the keying device 50, 52 to the connector 24, 26. In some embodiments, the mechanical attachment feature 80 may form part of a unitary structure with the flange portion 54. In some embodiments, the mechanical attachment features 80 may be configured to interface with exterior surfaces of the connector flange portion 28, 30 and to attach thereto. FIGS. 5A and 5B illustrate side cross-sectional views of the keying device 50, 52 of FIG. 4 taken along Line 5-5 and including exemplary mechanical attachment features 80. As shown in FIG. 5A, in some embodiments, the keying device 50, 52 may include a retaining member 82 extending from the flange portion 54 of the keying device 50, 52. For example, the retaining member 82 may extend from the back surface 60 of the keying device 50, 52 in a direction away from the flange portion 54. In some embodiments, the retaining member 82 may extend fully about the flange portion 54 with respect to the connector axis 74. In some other embodiments, the retaining member 82 may be segmented or may otherwise extend around only a portion or portions of the flange portion 54 with respect to the connector axis 74. The retaining member 82 includes a retaining surface 84 configured to contact and provide secure attachment (e.g., by friction fit) to the connector flange portion 28, 30. For example, the retaining surface 84 of the retaining member 82 may wrap tightly around an exterior perimeter of the connector flange portion 28, 30. As shown in FIG. 5B, in some embodiments, the keying device 50, 52 may include one or more clips 86 extending from the flange portion 54 of the keying device 50, 52. For example, the clips 86 may extend from the back surface 60 of the keying device 50, 52 in a direction away from the flange portion 54. The clips 86 may be configured to snap into an attached position on the connector flange portion 28, 30 for example, with the connector flange portion 28, 30 secured between the flange portion 54 and the clips 86 in contact with a back surface of the connector flange portion 28, 30.

Figure 6B:
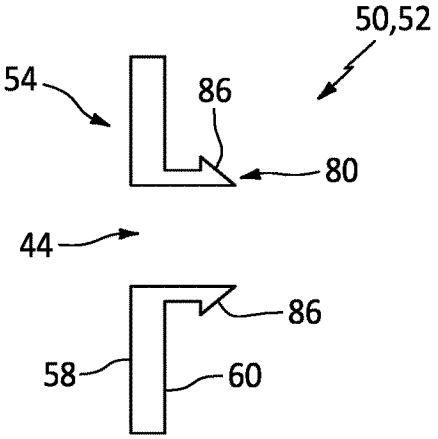
FIGS. 6A-B illustrate side cross-sectional views of the connector keying device of FIG. 4 taken along Line 6-6 and including exemplary mechanical attachment features, in accordance with one or more embodiments of the present disclosure.
Figure 5A:
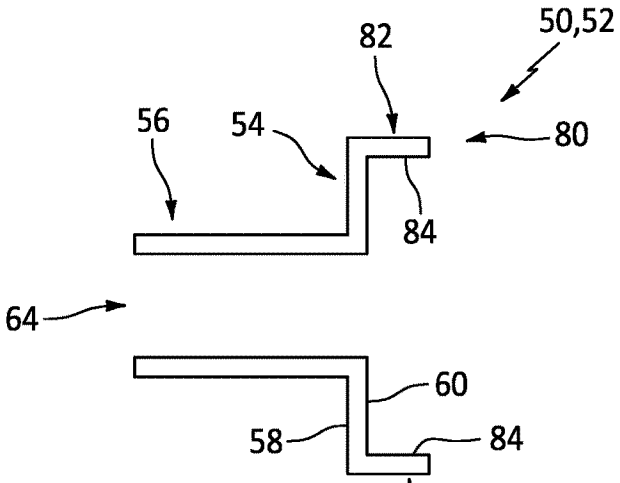
Figure 6A:
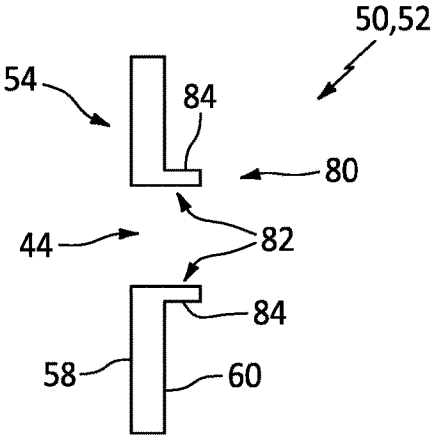
Figure 7:
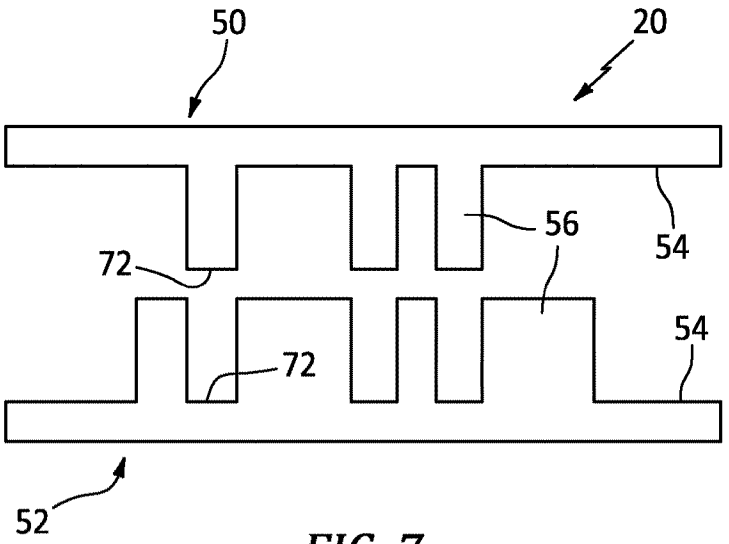
FIGS. 7-10 illustrate top views of exemplary connector keying systems, in accordance with one or more embodiments of the present disclosure.
Figure 8:
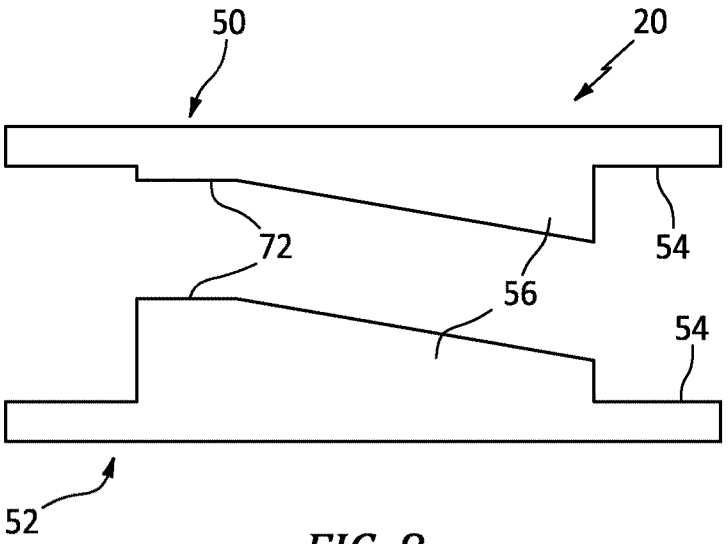
Figure 9:
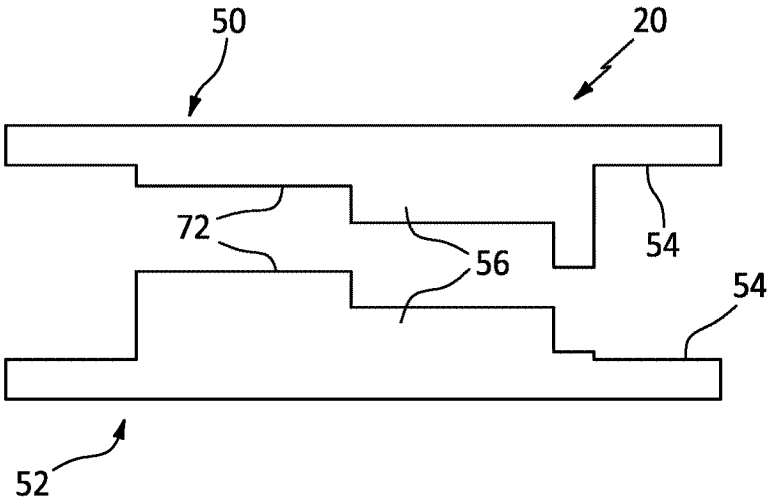
Figure 10:
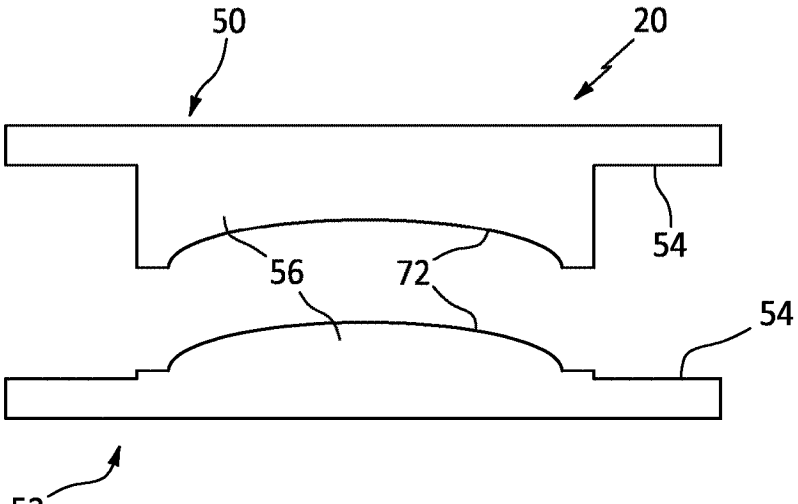
Figure 12:
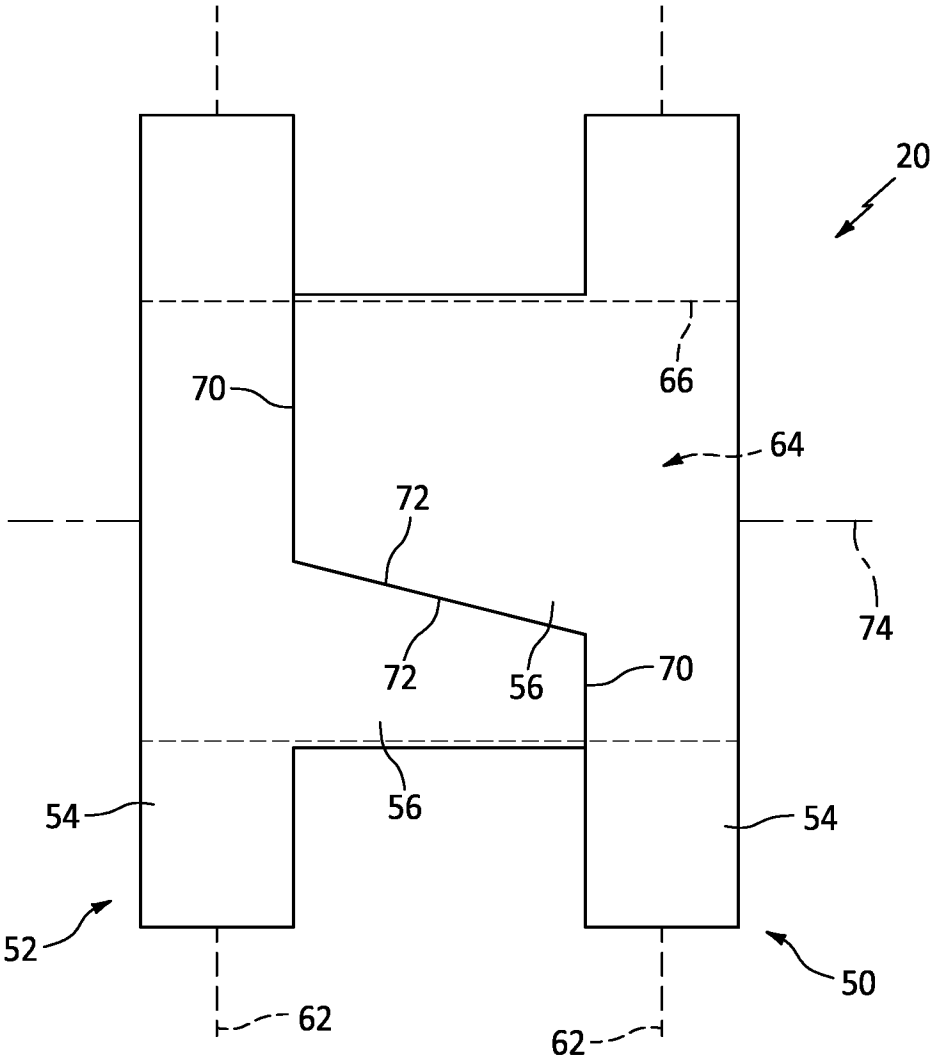
FIG. 12 illustrates a top view of the connector keying system of FIG. 11, in accordance with one or more embodiments of the present disclosure.
Figure 11:
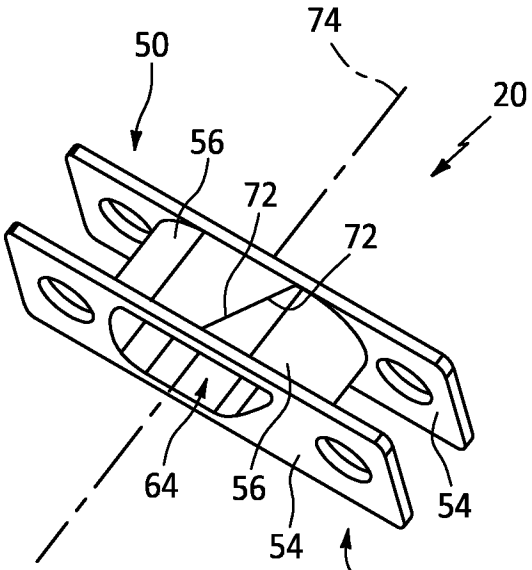
FIG. 11 illustrates a perspective view of the connector keying system of FIG. 3 in a mated condition, in accordance with one or more embodiments of the present disclosure.

In some embodiments, the mechanical attachment features 80 may be configured to interface with interior surfaces of the connector flange portion 28, 30 and to attach thereto. FIGS. 6A and 6B illustrate side cross-sectional views of the keying device 50, 52 of FIG. 4 taken along Line 6-6 and including exemplary mechanical attachment features 80. As shown in FIG. 6A, in some embodiments, the keying device 50, 52 may include the retaining member 82 extending from the back surface 60 of the flange portion 54 of the keying device 50, 52 in a direction away from the flange portion 54. The retaining member 82 may extend about the fastener aperture 44 for one or more of fastener apertures 44 of a keying device 50, 52. As previously discussed, the retaining member 82 includes the retaining surface 84 configured to contact and provide secure attachment (e.g., by friction fit) to the connector flange portion 28, 30. For example, retaining member 82 may fit tightly within a corresponding connector fastener aperture 46, 48 with the retaining surface 84 in contact with the interior surface of the connector flange portion 28, 30 defining the connector fastener aperture 46, 48. As shown in FIG. 6B, in some embodiments, the keying device 50, 52 may include one or more clips 86 extending from the back surface 60 of the flange portion 54 of the keying device 50, 52 in a direction away from the flange portion 54. The clips 86 may be configured to pass through a corresponding connector fastener aperture 46, 48 and snap into an attached position on the connector flange portion 28, 30 for example, with the connector flange portion 28, 30 secured between the flange portion 54 and the clips 86 in contact with a back surface of the connector flange portion 28, 30.

Referring to FIGS. 3-12, under the present disclosure, the keying portion 56 of the keying devices 50, 52 may assume a variety of different geometries. FIGS. 3, 4, and 7-10 illustrate various exemplary keying portion 56 shapes and configurations and the present disclosure is not limited to the particular keying portion 56 shapes and configurations illustrated herein. The first keying device 50 and the second keying device 52 of the present disclosure connector keying system 20 may be shaped so that the keying portions 56 of the respective keying devices 50, 52 can be mated with one another along their respective keying perimeters 72. With the second end 70 of the keying portion 56 of the first keying device 50 mounted against the second end 70 of the keying portion 56 of the second keying device 52, the flange plane 62 of the first keying device 50 may be substantially parallel to the flange plane 62 of the second keying device 52. In some embodiments, the respective keying portions 56 of the first keying device 50 and the second keying device 52 may be shaped so that the respective keying portions 56 can be positioned in contact with one another along all or substantially all of their respective keying perimeters 72. In some embodiments, the first keying device 50 and the second keying device 52 may be substantially identical to one another. In some other embodiments, such as those shown in FIGS. 7-10, the first keying device 50 and the second keying device 52 may include differently shaped respective keying portions 56 but may be configured to mate along their respective keying perimeters 72 as discussed above.

Figure 13:
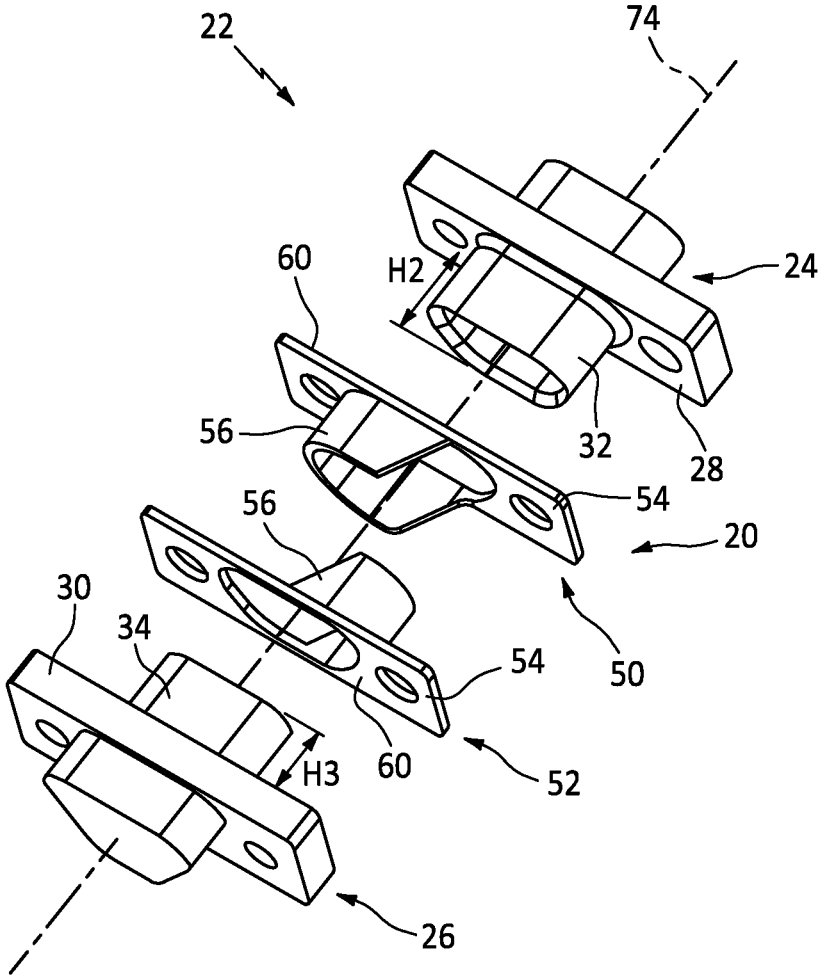
FIG. 13 illustrates an exploded perspective view of a connector system including a connector pair and connector keying system, in accordance with one or more embodiments of the present disclosure.
Figure 14:
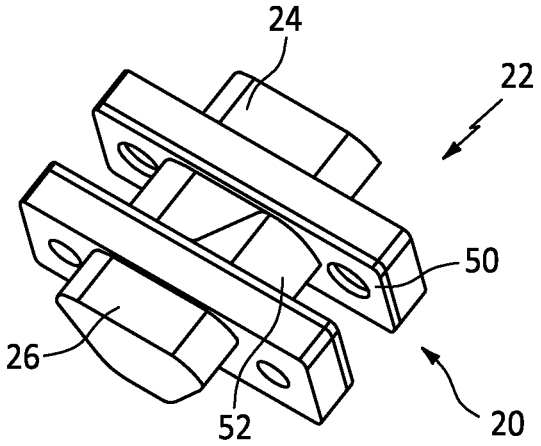
FIG. 14 illustrates a perspective view of the connector system of FIG. 13 in an assembled condition with the connectors electrically coupled, in accordance with one or more embodiments of the present disclosure.

Referring to FIGS. 13 and 14, the following description of the operation of the connector keying system 20 described and illustrated with respect to a connector pair 22 such as, for example, a connector pair 22 shown in FIG. 1 or 2. As indicated above, the present disclosure connector keying system 20 is not limited to use with a particular connector pair 22 configuration, and the configuration of the connector pair 22 and associated connector keying system 20 shown in FIGS. 13 and 14 is used herein solely for the purpose of explaining the connector keying system 20 operation.

To utilize the connector keying system 20, the first keying device 50 and the second keying device 52 are installed on the male connector 24 and the female connector 26 of a connector pair 22, for example, where the male connector 24 and the female connector 26 are intended for electrical coupling; e.g., to complete an electrical/electronic signal and/or current path between two components. As shown in FIGS. 13 and 14, the first keying device 50 may be installed on the male connector 24 so that the back surface 60 of the flange portion 54 contacts the flange portion 28 of the male connector 24 and the keying portion 56 surrounds the shell portion 32 of the male connector 24. Similarly, the second keying device 52 may be installed on the female connector 26 so that the back surface 60 of the flange portion 54 contacts the flange portion 30 of the female connector 26 and the keying portion 56 surrounds the shell portion 34 of the female connector 26. With the connector keying system 20 installed on the connector pair 22 and with the male connector 24 and the female connector 26 electrically coupled, the keying portions 56 of the first keying device 50 and the second keying device 52 may completely surround and enclose the shell portions 32, 34 of the male connector 24 and the female connector 26 as shown, for example, in FIG. 14.

In embodiments of the connector keying system 20 including an attachment feature such as the adhesive 76 (see FIG. 4) or the mechanical attachment features 80 (see FIGS. 5 and 6), as previously discussed, may be used to attach the keying devices 50, 52 to the respective connectors 24, 26. For example, the adhesive 76 may first be applied to the back surface 60 of one or both of the keying devices 50, 52 or the release liner 78 may be removed to expose the adhesive 76, prior to installing the first keying device 50 and/or the second keying device 52. The subsequent installation of the first keying device 50 and/or the second keying device 52 may, therefore, attach the keying device 50, 52 to the flange portion 28, 30 of the respective connector 24, 26 with the adhesive 76 or the mechanical attachment features 80.

As shown in FIG. 13, the shell portion 32 of the male connector 24 has a height H2 and the shell portion 34 of the female connector 26 has a height H3. In some embodiments, the height H2 of the shell portion 32 of the male connector 24 may be greater than the height H1 (see FIG. 4); e.g., a maximum of the height H1, of the keying portion 56 of the first keying device 50 so that a portion of the shell portion 32 extends past the keying portion 56. Additionally or alternatively, the height H3 of the shell portion 34 of the female connector 26 may be greater than the height H1 (see FIG. 4); e.g., a maximum of the height H1, of the keying portion 56 of the second keying device 52 so that a portion of the shell portion 34 extends past the keying portion 56. The reduced height H1 of the keying portion 56 relative to one or both of the heights H2, H3 may help ensure electrical coupling between the connectors 24, 26 by allowing complete insertion of the male connector 24 with the female connector 26.

Figure 15:
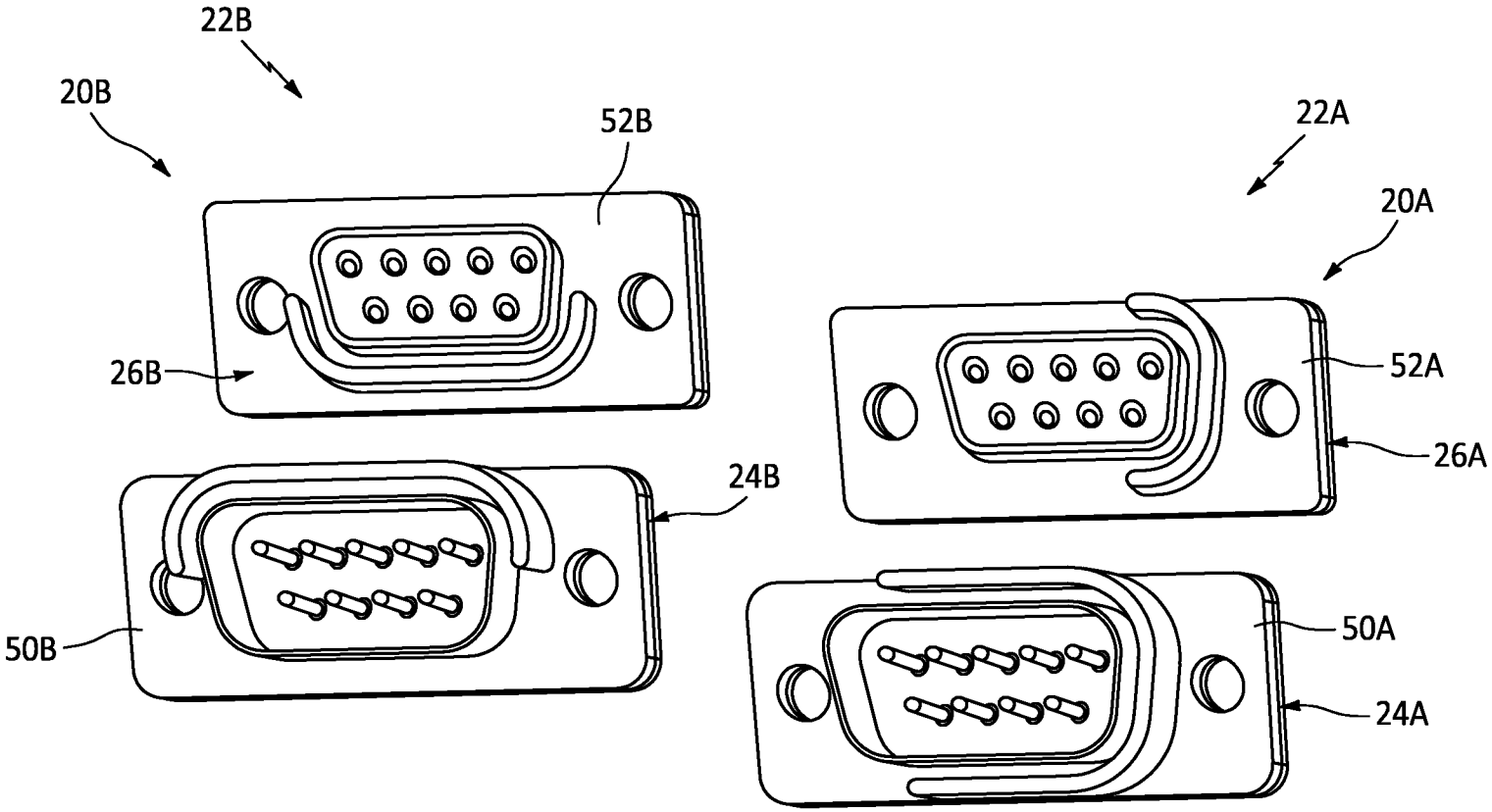
FIG. 15 illustrates perspective views of exemplary connector systems, in accordance with one or more embodiments of the present disclosure.

Referring to FIGS. 13-15, with the connector keying system 20 installed on the connectors 24, 26 of the connector pair 22, the connector keying system 20 will allow electrical coupling of the male connector 24 with the female connector 26, as shown in FIG. 13, while also preventing the misconnection of either of the male connector 24 or the female connector 26 with other connectors outside of the connector pair 22. As an example, FIG. 15 illustrates a first connector pair 22A and a second connector pair 22B. The first connector pair 22A has installed thereon a first unique connector keying system 20A. The second connector pair 22B has installed thereon a second unique connector keying system 20B, which is different than the first connector keying system 20A. The connector pairs 22A, 22B include a common connector style such that the male connector 24A and the female connector 26A of the first connector pair 22A can be electrically and mechanically coupled with the female connector 26B and the male connector 24B of the second connector pair 22B, respective, absent the connector keying systems 20A, 20B. However, the different shapes of the first connector keying system 20A and the second connector keying system 20B physically prevent electrical and mechanical coupling of the connectors 24A, 26A of the first connector pair 22A with the connectors 24B, 26B of the second connector pair 22B, for example, by physically obstructing the complete insertion of the female connector 26A with the male connector 24B or the female connector 26B with the male connector 24A. In other words, a first keying device 50A of the first connector keying system 20A installed on the male connector 24A will physically prevent electrical coupling between the male connector 24A and the female connector 26B having a second keying device 52B of the second connector keying system 20B installed thereon. Similarly, a first keying device 50B of the second connector keying system 20B installed on the male connector 24B will physically prevent electrical coupling between the male connector 24B and the female connector 26A having a second keying device 52A of the second connector keying system 20A installed thereon.

In some embodiments, different instances of the connector keying system 20 may have different colors in order to assist users with properly identifying the connectors 24, 26 belonging to a specific connector pair 22, thereby reducing the risk of misconnection. For example, electrical and/or electronic systems may include numerous connector pairs, such as the connector pair 22, which may be susceptible to connector misconnection. Different instances of the connector keying system 20 each associated with a respective connector pair 22 may be assigned different colors to assist users with properly identifying the connectors 24, 26 belonging to a specific connector pair 22. Referring again to FIG. 15 to provide a non-limiting example, the first connector keying system 20A may have a first color and the second connector keying system 20B may have a second color which is different than the first color. Accordingly, a user may be able to more readily avoid connector misconnection by ensuring that electrical coupling only occurs between connectors 24, 26 with like colored connector keying systems 20. While the above-discussed example describes the use of colors to visually distinguish connector keying systems 20 and prevent connector misconnections, other visual indications may be used such as, but not limited to, shapes, symbols, text, serial numbers, bar codes, etc.

The present disclosure connector keying system 20 provides for a reduction of the likelihood of misconnection between electrical connectors and does not require any modification to existing connectors, such as those illustrated in FIGS. 1 and 2, or any subsequent configuration after installation of the connector keying system 20. Moreover, because the connector keying system 20 is entirely retained between electrically coupled connectors, the connector keying system cannot become loose or fall away from an associated connector pair and does not include any additional keying components (e.g., keying pins), in comparison to prior art keying systems, which can become separated.

It is noted that various connections are set forth between elements in the preceding description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. References to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Accordingly, the present disclosure is not to be restricted except in light of the attached claims and their equivalents.

What is claimed is:

1. A connector keying system for use with a connector pair, the connector keying system comprising:

at least one keying device comprising a flange portion and a keying portion, the flange portion including a front surface and a back surface opposite the front surface, each of the front surface and the back surface extending substantially parallel to a flange plane, the flange portion further comprising a connector aperture extending through the flange portion from the back surface to the front surface, the keying portion extending around an aperture perimeter of the connector aperture and projecting outward from the flange portion in a direction substantially perpendicular to the flange plane, the keying portion including and extending between a first key end located at the front surface and a second key end opposite the first key end, the second key end defining a keying perimeter about the connector aperture, the keying portion having a height between the first key end and the second key end and the height is inconsistent between the first key end and the second key end along the keying perimeter; wherein the at least one keying device includes a first keying device and a second keying device and wherein with the second key end of the first keying device mounted against the second key end of the second keying device about the respective keying perimeter of the first keying device and the second keying device, the flange plane of the first keying device is substantially parallel to the flange plane of the second keying device.

2. The connector keying system of claim 1, wherein the second key end of the keying portion is skewed relative to the flange plane along a first portion of the keying perimeter.

3. The connector keying system of claim 2, wherein the second key end of the keying portion is substantially parallel to the flange plane along a second portion of the keying perimeter.

4. The connector keying system of claim 1, wherein the flange portion includes at least one fastener aperture extending through the flange portion from the back surface to the front surface.

5. The connector keying system of claim 1, wherein the at least one keying device includes at least one attachment feature.

6. The connector keying system of claim 1, wherein the keying portion extends from the flange portion at a location of the aperture perimeter.

7. A connector system comprising:

a first connector pair comprising a first male connector and a first female connector configured for electrical coupling with the first male connector, each of the first male connector and the first female connector comprising a connector flange portion and a connector shell portion extending outward from the connector flange portion, the connector shell portion of the first male connector surrounding a plurality of pins and the connector shell portion of the first female connector surrounding a plurality of sockets configured to receive the respective plurality of pins; and a first connector keying system comprising a first at least one keying device comprising a flange portion and a keying portion, the flange portion including a front surface and a back surface opposite the front surface, each of the front surface and the back surface extending substantially parallel to a flange plane, the flange portion further comprising a connector aperture extending through the flange portion from the back surface to the front surface, the keying portion extending around an aperture perimeter of the connector aperture and projecting outward from the flange portion in a direction substantially perpendicular to the flange plane, the keying portion including and extending between a first key end located at the front surface and a second key end opposite the first key end, the second key end defining a keying perimeter about the connector aperture, the keying portion having a height between the first key end and the second key end and the height is inconsistent between the first key end and the second key end along the keying perimeter, the at least one keying device configured for installation on one or both of the male connector and the female connector so that the back surface of the flange portion contacts the connector flange portion and the keying portion surrounds the connector shell portion.

8. The connector system of claim 7, wherein the first at least one keying device includes a first keying device installed on the first male connector and a second keying device installed on the first female connector and wherein the first at least one keying device is configured so that, with the second key end of the first keying device mounted against the second key end of the second keying device about the respective keying perimeter of the first keying device and the second keying device, the flange plane of the first keying device is substantially parallel to the flange plane of the second keying device.

9. The connector system of claim 8, further comprising:

a second connector pair comprising a second male connector and a second female connector configured for electrical coupling with the second male connector, the second male connector configured for electrical coupling with the first female connector and the second female connector configured for electrical coupling with the first male connector; and a second connector keying system comprising a second at least one keying device including a third keying device installed on the second male connector and a fourth keying device installed on the second female connector.

10. The connector system of claim 9, wherein the first keying device and the second keying device are a first matching color and the third keying device and the fourth keying device are a second matching color, different than the first matching color.

11. The connector system of claim 9, wherein the first keying device is configured to physically prevent electrical coupling of the second female connector with the first male connector and the second keying device is configured to physically prevent electrical coupling of the second male connector with the first female connector.

12. The connector system of claim 11, wherein the third keying device and the fourth keying device are different than the first keying device and the second keying device, respectively.

13. The connector system of claim 12, wherein the respective keying portion of the third keying device and the fourth keying device has a different shape than the respective keying portion of the first keying device and the second keying device, respectively.

14. The connector system of claim 7, wherein the first at least one keying device includes at least one attachment feature and wherein the at least one attachment feature attaches the first at least one keying device to the connector flange portion.

15. The connector system of claim 7, wherein the connector shell portion includes and extends between a first shell end in contact with the connector flange portion and a second shell end opposite the first shell end, wherein the connector shell portion has a second height between the first shell end and the second shell end, and wherein the second height is greater than a maximum of the height between the first key end and the second key end.

16. A method for preventing electrical misconnection for a connector system, the method comprising:

providing a first connector pair comprising a first male connector and a first female connector configured for electrical coupling with the first male connector, each of the first male connector and the first female connector comprising a connector flange portion and a connector shell portion extending outward from the connector flange portion, the connector shell portion of the first male connector surrounding a plurality of pins and the connector shell portion of the first female connector surrounding a plurality of sockets configured to receive the respective plurality of pins; and installing a first at least one keying device on one or both of the male connector and the female connector so that a back surface of a flange portion of the first at least one keying device contacts the connector flange portion and a keying portion of the at least one keying device surrounds the connector shell portion, the flange portion including a front surface and the back surface opposite the front surface, each of the front surface and the back surface extending substantially parallel to a flange plane, the flange portion further comprising a connector aperture extending through the flange portion from the back surface to the front surface, the keying portion extending around an aperture perimeter of the connector aperture and projecting outward from the flange portion in a direction substantially perpendicular to the flange plane, the keying portion including and extending between a first key end located at the front surface and a second key end opposite the first key end, the second key end defining a keying perimeter about the connector aperture, the keying portion having a height between the first key end and the second key end and the height is inconsistent between the first key end and the second key end along the keying perimeter.

17. The method of claim 16, wherein the first at least one keying device includes a first keying device and a second keying device, wherein the step of installing the first at least one keying device includes installing the first keying device on the first male connector and installing the second keying device on the first female connector, and wherein, with the first at least one keying device installed, the at least one keying device is configured so that, with the second key end of the first keying device mounted against the second key end of the second keying device about the respective keying perimeter of the first keying device and the second keying device, the flange plane of the first keying device is substantially parallel to the flange plane of the second keying device.

18. The method of claim 17, further comprising:

providing a second connector pair comprising a second male connector and a second female connector configured for electrical coupling with the second male connector;

wherein the second male connector is configured for electrical coupling with the first female connector and the second female connector is configured for electrical coupling with the first male connector; and wherein the first keying device is configured to physically prevent electrical coupling of the second female connector with the first male connector and the second keying device is configured to physically prevent electrical coupling of the second male connector with the first female connector.

19. The method of claim 16, further comprising attaching the at least one keying device to the connector flange portion with at least one attachment feature.

* * * * *